United States Patent [19]

Madsen et al.

[11] Patent Number: 4,697,334

[45] Date of Patent: Oct. 6, 1987

[54] METHOD OF PRODUCING ELECTROACOUSTIC CONVERTERS, PREFERABLY MICROPHONES, AND CONVERTERS PRODUCED ACCORDING TO THE METHOD

[75] Inventors: Henning S. Madsen; Tommy S. Sergerö; Karl A. Johansson, all of Tyresö , Sweden

[73] Assignee: Telefonaktiebolaget L M Ericsson, Stockholm, Sweden

[21] Appl. No.: 684,594

[22] Filed: Dec. 21, 1984

[30] Foreign Application Priority Data

Dec. 22, 1983 [SE] Sweden ..... 8307124

[51] Int. Cl.[4] ..... H04R 31/00; H04R 1/02; H04R 7/00; H04R 19/00

[52] U.S. Cl. ..... 29/594; 381/174; 381/191; 381/202

[58] Field of Search ..... 179/138, 140, 121 R, 179/111 E, 181 R, 178, 177; 29/529 E, 592 R, 594; 381/174, 191, 202

[56] References Cited

U.S. PATENT DOCUMENTS

| | | | |
|---|---|---|---|
| 2,518,805 | 8/1950 | Massa | 381/69 |
| 3,663,768 | 5/1972 | Madsen et al. | 381/191 |
| 4,331,840 | 5/1982 | Murphy et al. | 381/153 |
| 4,429,193 | 1/1984 | Busch-Vishniac et al. | 381/191 |
| 4,511,768 | 4/1985 | Patel | 381/159 |

FOREIGN PATENT DOCUMENTS

| | | | |
|---|---|---|---|
| 2029161 | 3/1980 | United Kingdom | 179/111 E |

OTHER PUBLICATIONS

PCT reference, WO83/01362, "Lead-Frame for an Electret Microphone", Madsen et al., published Apr. 14, 1983.

*The Bell System Technical Journal,* "The E12 Electret Transmitter Analytical Modeling, Optimization, and Design," vol. 58, No. 7, Sep. 1979, pp. 1557–1578.

*Primary Examiner*—Gene Z. Rubinson
*Assistant Examiner*—Danita R. Byrd
*Attorney, Agent, or Firm*—Roberts, Spiecens & Cohen

[57] ABSTRACT

An electroacoustic converter with a closed-off resonance chamber, e.g. a microphone, including frame (1) carrying an electrode (2) and a diaphragm (3) connected by a connecting member (5) to an amplifier. A band (17) of plastically deformable material is sealingly attached to the frame via a weld joint (15) for providing good bass reproduction. The sensitivity of the microphone, which depends on the volume of the resonance chamber, is adjusted to the desired value by forming a depression (16) in the band. In production, the frames (1) are attached to the band (17) and are conveyed thereby between different operation stations. Sensitivity is measured by a measuring apparatus (20) and a loudspeaker (18) and is adjusted by a tool (19).

6 Claims, 3 Drawing Figures

METHOD OF PRODUCING ELECTROACOUSTIC CONVERTERS, PREFERABLY MICROPHONES, AND CONVERTERS PRODUCED ACCORDING TO THE METHOD

FIELD OF THE INVENTION

The invention relates to a method of producing electroacoustic converters with closed resonance chambers, preferably microphones, and converters produced according to the method, including a frame surrounding said resonance chamber a diaphragm closing off the resonance chamber, and means providing electrical connection.

BACKGROUND

In electroacoustic converters with good bass reproduction, the resonance chamber between the diaphragm and the rear side of the converter must be closed. Such known converters have a fixed rear side, and the volume of this resonance chamber cannot be changed to adjust the sensitivity of the microphone. It has been proposed to provide such converters, e.g. microphones, with a movable piston so that adjustment can be made. This, however, results in the creation of large leaks in the resonance chamber, and this deleteriously affects the bass reproduction of the microphone. There are also problems with the item-by-item handling of the microphones during production.

SUMMARY OF THE INVENTION

The basic concept of the invention is to attach electroacoustic converters to a common band or strip, which forms a sealed-off and deformable rear side, enabling continuous manufacture.

In accordance with the invention, there is provided a method of producing an electroacoustic converter with a closed resonance chamber comprising placing the underside of a frame having a hollow annular region on a strip of plastically deformable material, sealingly attaching the strip to the frame around the hollow annular region and securing a diaphragm to the top of the frame to form a resonance chamber in the hollow annular region bounded on the bottom by the strip and on top by the diaphragm. An electrical connection is made to the diaphragm and the sensitivity of the converter is measured. The strip is deformed within the resonance chamber to vary the volume of the resonance chamber thereby to adjust the sensitivity of the converter to a predetermined value. The assembled converter is then separated from the rest of the strip.

BRIEF DESCRIPTION OF DRAWINGS

One embodiment of the invention will now be described in connection with the drawing, where.

DETAILED DESCRIPTON OF A BEST MODE FOR CARRYING OUT THE INVENTION

Figure 1:
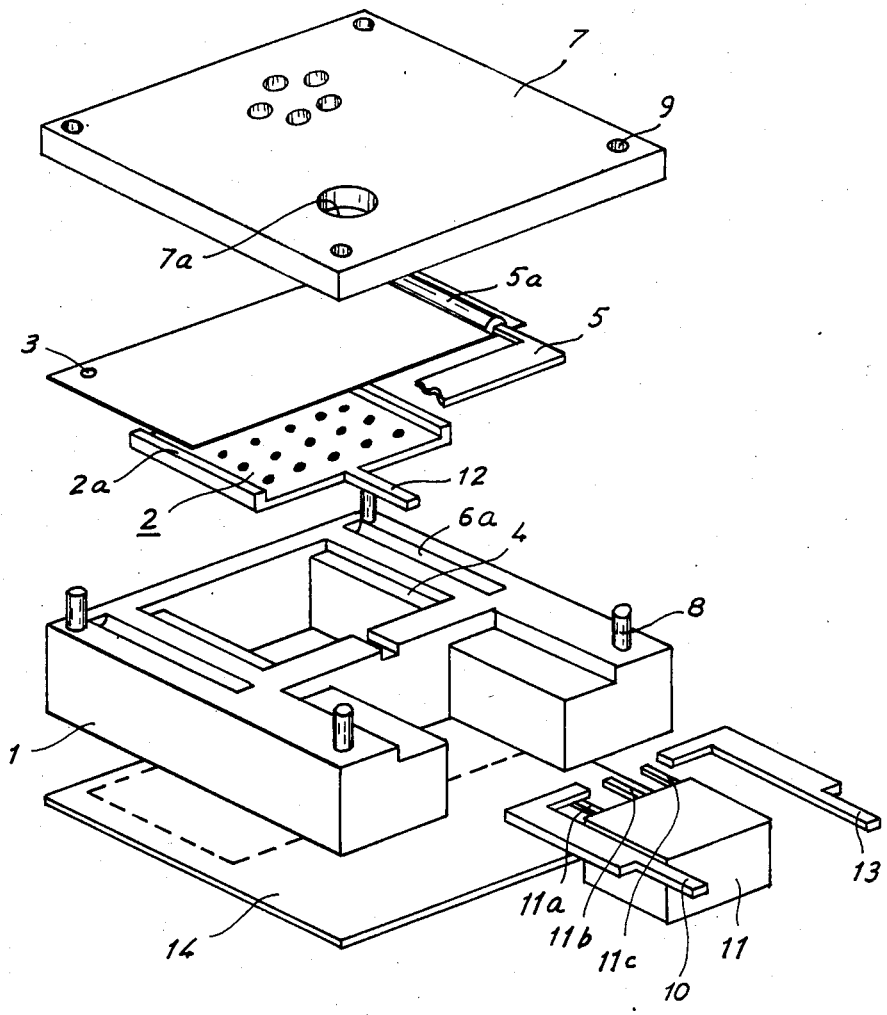
FIG. 1 is a perspective, exploded view of a microphone with a closed resonance chamber.

FIG. 1 illustrates an electret microphone in which a hollow frame 1 having an annular region conventionally carries an electrode 2 and a microphone diaphragm 3. The latter is an electret film having a metallic coating on its upper surface. At its short ends, the electrode rests in a recess 4 in the frame and is fixed in position by stretching the diaphragm 3 over ridges 2*a* on the electrode. The diaphragm is retained by a fork-shaped electrical connecting member 5, only a part of which is shown. The diaphragm is kept pressed into grooves 6*a* in the upper side of the frame by the connecting member 5, which is in turn kept in a downwardly pressed position by a cover 7, the under side of which has grooves 6*b* (see FIG. 2) corresponding to the grooves 6*a*. The cover 7 is attached to the frame by projections 8, which engages in holes 9 in the cover. The connecting member 5 is made of metal and has a coating 5*a* of electrically conductive silicone rubber, partly to keep the diaphragm 3 located in the grooves by elastic force, and partly to constitute an electrical connection to the diaphragm. A hole 7*a* is formed in the cover to provide access by which the connecting member 5 is electrically connected to an outer connection tab 10, which is connected in turn by a pin 11*a* to an integrated amplifier 11. By means of a projection 12, the electrode 2 is placed in contact with a connection pin 11*b* on the amplifier, which has a further pin 11*c* in contact with an exterior connection tab 13.

Figure 2:
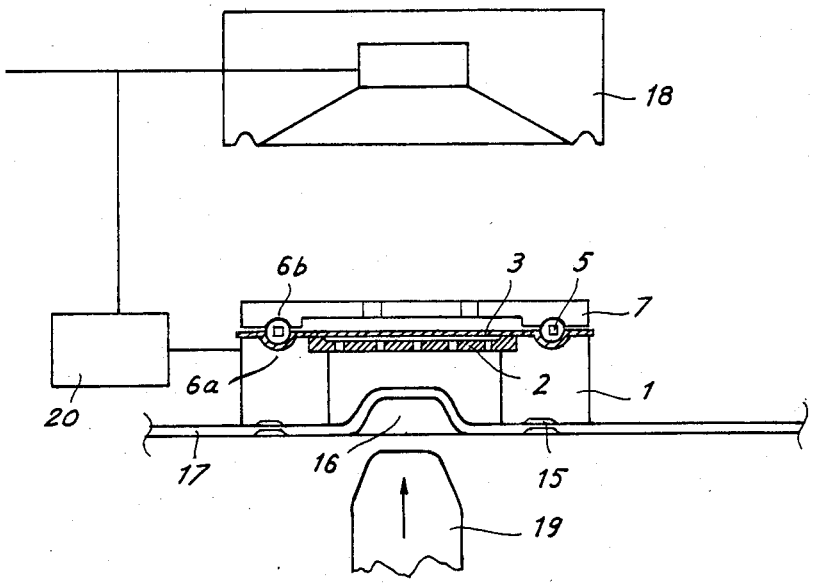
FIG. 2 is an elevation view, partly in cross section through a microphone supported on a band also depicting means for measuring and adjusting its sensitivity.

In accordance with the invention, the frame 1 of the microphone has on its underside a wafer 14 of plastically deformable material. The wafer is sealingly attached to the frame 1 by a weld 15 extending around the annular region of the frame and illustrated in solid lines in FIG. 2, and in dotted lines in FIG. 1. The resonance chamber between the wafer 14 and diaphragm 3 will thus be closed, which gives the microphone good bass reproduction. The sensitivity of the microphone, i.e. the relationship between the received sound strength and electrical signals sent, is dependent on the volume of the resonance chamber. The volume of the resonance chamber can be changed to obtain the desired sensitivity by deforming the wafer to provide a recess 16 as shown in FIG. 2.

Figure 3:
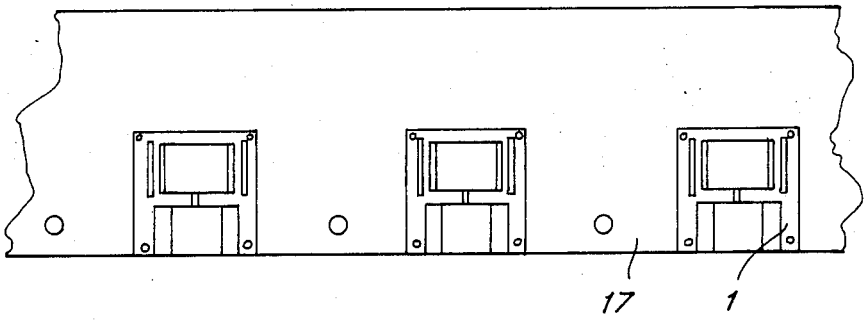
FIG. 3 illustrates frames of microphones attached to a band.

The microphones described above are produced by a method according to the invention in the following way. At an operation station, the frames are placed at given spacing, suitably along the edge of a band 17 of thermoplastic resin, as illustrated in FIG. 3. The frames are then welded to the band so that the joint formed by weld 15 is obtained. The frames are then conveyed by the band 17 to a series of operation stations where the following operations are performed:

The electrode 2, amplifier 11 and connection tabs 10 and 13, which are connected to each other by welding as described above, are placed in the frame. The diaphragm 3 is stretched over the electrode 2 and fixed into position by being pressed into the grooves 6*a* in the frame by the connection member 5 with the aid of the cover 7. Cover 7 is fastened to the frame by the engagement of the projections 8 in the holes 9 and forming the rivet heads on projections 8 at increased temperature on the upper side of the cover. The diaphragm 3 is connected electrically to the connection tab 10 by welding the connecting member 5 and the tab 10 together at a spot accessible through the hole 7*a* in the cover. The microphone is connected to measuring apparatus 20, indicated in FIG. 2, and its output signal measured and compared with a reference signal from a loudspeaker 18 supplying sound to the microphone. The sensitivity of the microphone thus measured is adjusted by pressing a tool 19 at a raised temperature against the band 17 whithin the frame 1 so that the recess 16 is formed. The volume of the resonance chamber is thus reduced until the desired sensitivity is obtained, whereafter further insertion by the tool is stopped.

After the sensitivity of the microphone has been adjusted, it is released from the band by cutting the latter along the edge of the frame. The microphones are then encapsulated conventionally in a protective capsule and their sensitivity checked by a new measurement.

What is claimed is:

1. A method of producing an electroacoustic converter with a closed resonance chamber, said method comprising placing the underside of a frame having a hollow annular region on a strip of deformable, plastic material which extends beyond the frame, sealingly attaching the strip to the frame around said hollow annular region, securing a diaphragm to the top of the frame to form a resonance chamber in the hollow annular region bounded on the bottom by the strip and on the top by the diaphragm, providing an electrical connection to the diaphragm, measuring sensitivity of the converter and permanently deforming said strip within the resonance chamber to vary the volume of said resonance chamber to adjust the sensitivity of the converter to a predetermined value and separating said converter from the strip outside the region where the strip and frame are sealingly attached.

2. A method as claimed in claim 1 wherein said diaphragm is secured to the frame by stretching the diaphragm over the frame to cover said hollow annular region, and pressing said diaphragm by a connecting member into grooves provided in said frame, said electrical connection being formed between the connecting member, the diaphragm and an external connection of said connecting member.

3. A method as claimed in claim 2 wherein the diaphragm is an electret film and the method further comprises mounting an electrode on said frame facing said diaphragm, and providing an electrical connection to said electrode.

4. A method as claimed in claim 1 wherein said strip is elongated so that a plurality of said frames for respective converters can be attached on said strip one after the other and the deforming of the strip is effected at an operating station.

5. A method as claimed in claim 4 wherein said strip has an edge and the frames are aligned on said edge and advanced to the operating station one after the other.

6. A method as claimed in claim 3 comprising mounting an amplifier on the frame outside said resonance chamber, said electrode and diaphragm being electrically connected to said amplifier.

* * * * *